United States Patent [19]

Delia

[11] 4,054,263

[45] Oct. 18, 1977

[54] MAGNETIZED STAPLE REMOVER

[76] Inventor: Michael Delia, 110 Warwick Ave., Douglas Manor, N.Y. 11363

[21] Appl. No.: 698,904

[22] Filed: June 23, 1976

[51] Int. Cl.[2] ..... B25C 11/00

[52] U.S. Cl. ..... 254/28

[58] Field of Search ..... 254/28

[56] References Cited

U.S. PATENT DOCUMENTS

| | | | |
|---|---|---|---|
| 3,528,643 | 9/1970 | Munson et al. | 254/28 |
| 3,761,057 | 9/1973 | Nembhard et al. | 254/28 |
| 3,764,108 | 10/1973 | Dahlin | 254/28 |
| 3,974,999 | 8/1976 | Bertolet | 254/28 |

*Primary Examiner*—Robert C. Watson
*Attorney, Agent, or Firm*—Robert D. Farkas

[57] ABSTRACT

This disclosure pertains to a pincer-like staple remover having a pair of elongated arms to which are affixed a pair of complementary jaws. The arms are biased to assume a divergent position relative to the interconnected ends thereof. The jaws are fabricated from a metallic material, each of which utilizes a pair of parallel spaced apart plates. A portion of the jaws, adjacent the staple grasping portions thereof, are fabricated from a non-magnetic plastic material and are bridged by a magnetic plate contacting the spaced apart non-metallic plates. Staples, freed from a grasping position to a paper or cardboard substrate, are magnetically attracted by the magnetic plate and are caused to reside between the non-magnetic plastic walls forming a staple storing cavity there-in-between. The magnetic plate may be slidably removed from its metal plate bridging position, so as to empty the cavity of accumulated staples.

4 Claims, 2 Drawing Figures

MAGNETIZED STAPLE REMOVER

BACKGROUND OF THE INVENTION

1. The Field of the Invention

This invention relates to apparatus for the removal of wire staples from a surface and more particularly to that class of apparatus which retains the removed staple in the storage position in conjunction with the staple removal device.

2. Description of the Prior Art

The prior art abounds with staple removal apparatus. U.S. Pat. No. 3,764,108 issued on Oct. 8, 1973 to S. V. Dahlin teaches a one piece staple-removing device, of simplified construction, utilizing complementary jaws to withdraw the staple from the surface to which it has been affixed.

U.S. Pat. No. 3,484,080 issued on Dec. 16, 1969 to P. M. Tolliver discloses a staple remover utilizing a finger-like projection intermediate the complementry jaw portions thereof to grasp broken portions of the staple, facilitating their removal from the surface to which they are attached. The finger-like element is disposed intermediate the complementary jaw portions of the devic and grasp the elevated portions of the staple after being urged upwardly by the ramped surfaces of the jaws.

U.S. Pat. No. 2,932,538 issued on Apr. 12, 1960, to C. H. Holmes pertains to a pair of metallic plates forming part of a magnetic path induced by a permanent bar magnet, slideably mounted within a housing, and having the free ends thereof slideably passing through openings in the housing when it is desired to magnetically attract metals possessing magnetic properties, and withdrawn within the housing when it is desired to dispense such attracted materials.

All of the aforementioned Patents suffer the common deficiency of failing to provide an apparatus suitable for the removal of staples from a surface to which they are affixed and for the magnetic attraction and retention thereof within a cavity forming an integral part of the staple removing apparatus.

SUMMARY OF THE INVENTION

A primary object of the present invention is to provide a staple remover which magnetically attracts staples that have been removed from the surface to which they have been affixed.

Another object of the present invention is to provide a staple removing apparatus which stores dislodged staples within a cavity portion thereof.

Still another object of the present invention is to provide a staple removing apparatus whose staple storage cavity may be conveniently emptied of accumulated used staples.

Yet another object of the present invention is to provide a magnetic attraction path for dislodged staples which contacts the staple during the removal thereof from the surface to which the staple is affixed.

Heretofore, metal staples, once removed from the grasping position from the surface to which they are affixed, tended to fly about in an uncontrolled fashion representing a potential hazard to the individual dislodging the staple. Furthermore, dislodged staples were frequently caught up by the paper-like sheets previously bound together thereby, forcing the user to carefully remove them before inserting the sheets into photocopying devices which would otherwise become damaged due to the presence of dislodged staples. The present invention overcomes these hazards and objections by magnetically attracting dislodged staples and by retaining them, utilizing the same magnetic means within one or more cavities, formed within the staple removing apparatus until such time that the user thereof empties accumulated staples from the cavity.

These objects, as well as other objects of the present invention will become more readily apparent upon reading the following description of the accompanying drawings.

DESCRIPTION OF THE PREFERRED EMBODIMENNT

The structure and method of fabrication of the present invention is applicable to a staple removing apparatus comprising a pair of arms, each pivotably secured to each other at one end thereof. The arms consist of plastic material adjacent the pivoted ends thereof. A spring, having a semi-circular shape, disposes the other ends of the arms pivotably outwardly from each other and is located about the pivot rod pivotably connecting the arms together. The other end of each arm is fabricated from a pair of parallelably disposed spaced apart metallic plates each having a tongue-like jaw end formed at the free end thereof. The other arm is similarly constructed having its jaw-like ends disposed directed inwardly towards the first set of jaws, but having the spacing separating its plates greater than the spacing separating the plates in the first arm. Thus, when the arms are urged pivotably together, by exerting compressive forces on opposed finger gripping handles affixed to each arm, the complementary jaws engage one another so as to permit the tongue-like portions thereof to pass between a portion of the staple and outermost surface of the sheets which the staple grasps. The staple is then urged in the direction of the pivot rod, due to the tapered marginal edges of the tongues. Portions of each of the plates forming both metallic segments of both arms are fitted with a plastic non-magnetic material so as to form spaced apart walls of a cavity residing between their innermost opposed surfaces. A metallic magnetic plate, permanently magnetized is disposed within slots in each of the plastic material segments, preferably fabricated from a transparent material, so as to magnetically contact the metallic portions of the plates forming the complementary jaws of the apparatus. The magnetic plate may be slideably removed from the slots, otherwise retained in position by the magnetic forces grasping it to the metallic segments of the arms. Dislodged staples are propelld towards the magnetic plate, due to the magnetic attractive force thereof and are retained within the cavity, formed by the non-magnetic plastic side walls adjacent thereto until such time that the magnetic plate is slideably removed from its engaged position within the slots so as to empty accumulated dislodged staples from within the cavity.

An alternate embodiment includes portions of the tongue-ends of the arms being fabricated from a metallic material, for wear purposes, being totally disassociated from magnetic contact with the magnetized plate. The magnetized plate may then be retained within the slots utilizing frictional forces therefor. This embodiment permits light duty staples, otherwise free to be projected forcibly from the outermost surface of the sheets upon removal therefrom, to be captured within the compartment as opposed to heavy duty, less pliable staples, which tend to grasp the outermost sides of the arms upon their removal from the sheets.

Figure 1:
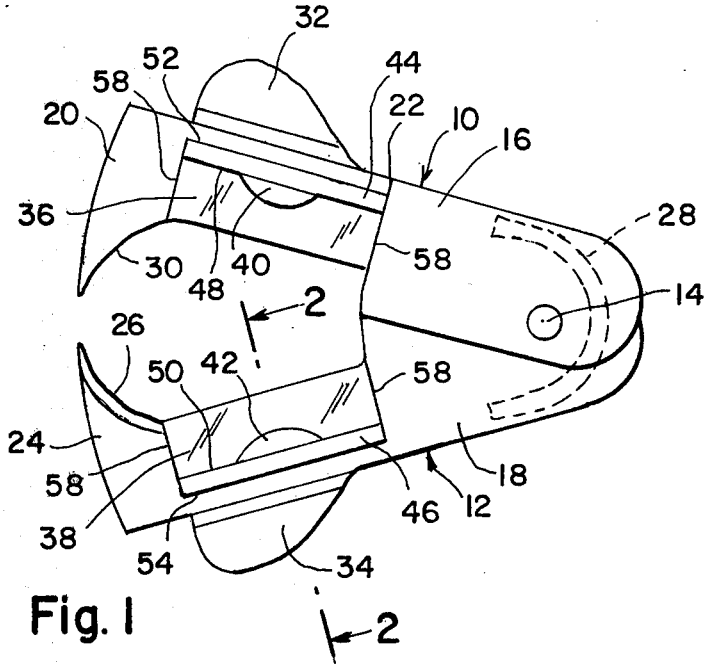
FIG. 1 is a side elevation view of the present invention.

Now referring to the Figures and more particularly to the embodiment illustrated in FIG. 1 showing an arm 10 and an arm 12 pivotably secured to each other about pivot rod 14. End 16 adjacent pivot rod 14 is fabricated from a plastic material devoid of magnetic properties. End 18 of arm 12 is similarly fabricated from a plastic material devoid of magnetic properties. Jaw-like end 20 is fabricated from metallic plates, one behind the other possessing magnetic properties and joining end 16 and point 22. End 24 of arm 12 is fabricated from the same plastic material utilized at end 18. Metallic tongue surface 26 similar to a facing, is affixed at end 24 to each of the plastic spaced apart plates, disposed one behind the other, comprising arm 12. It should be understood that arm 12, as shown, may be replaced by an arm constructed in similar fashion to arm 10. Conversley, arm 10 may be supplemented by an arm equivalent in construction to arm 12 creating thereby an alternate embodiment of the present invention. Spring 28 disposes the tongue surfaces 26 and 30 of arms 12 and 10 respectively pivotably outwardly from each other. Finger gripping handles 32 and 34 are affixed to arms 10 and 12 respectively, providing a comfortable thumb and forefinger grasping surface for the user of the present invention. Plastic windows 36 and 38 constitute portions of the plates forming arms 10 and 12 respectively and are fixedly secured thereto along lines 58. Tabs 40 and 42 are attached to magnetic plates 44 and 46 residing intermediate edges 48 and 50, of plastic windows 36 and 38 respectively and lines 52 and 54 of arms 10 and 12 respectively. Metallic plate 44 bridges the two metal plates comprising end 20 of arm 10, whilst metallic plate 46 bridges the two non-metallic plates comprising arm 12 but does not contact tongue surface 26 thereof.

Figure 2:
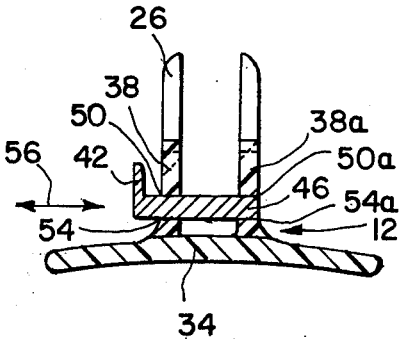
FIG. 2 is a front elevation cross-sectional view taken along line 2—2 viewed in the direction of arrows 2—2 of the present invention as shown in FIG. 1.

FIG. 2 illustrates magnetic plate 46 shown spanning window 38 and window 38*a,* parallel thereto. Tab 42 permits the convenient manually directed motion of magnetic plate 46 in the direction of arrows 56 from within or into the slots formed by lines 50 and 54 and lines 50*a* and 54*a* disposed at one edge of plastic windows 38 and 38*a* and the balance of arm 12.

One of the advantages of the present invention is a staple remover which magnetically attracts staples that have been removed from the surface to which they have been affixed.

Another advantage of the present invention is a staple removing apparatus which stores dislodged staples within a cavity portion thereof.

Still another advantage of the present invention is a staple removing apparatus whose staple storage cavity may be conveniently emptied of accumulated used staples.

Yet another advantage of the present invention is magnetic attraction path for dislodged staples which contacts the staple during the removal thereof from the surface to which the staple is affixed.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A magnetized staple remover comprising a pair of elongated arms, each of said pair of arms pivotably interconnected to each other at one end thereof, the other ends of said pair of arms having complementary jaws disposed thereat, means to bias said pair of arms pivotably outwardly from each other at said other ends thereof, said each of said pair of arms having a pair of parallel spaced apart plates extending along a portion of the length thereof, said pair of plates fabricated from a non-magnetic material, said other ends of said pair of arms fabricated from a magnetic material, means to magnetically attract metallic staples intermediate said pair of plates, said one end of said each of said pair of arms devoid of magnetic properties adjacent the pivotable interconnection thereinbetween.

2. The magnetized staple remover as claimed in claim 1 wherein said magnetic attraction means comprises a magnetized plate, said magnetized plate traversing said pair of parallel spaced apart plates.

3. The magnetized staple remover as claimed in claim 1 wherein said portion of said length comprises a plastic material, said plastic material devoid of magnetic properties, a metallic facing fixedly secured to said complementary jaws, said metallic facing magnetically disassociated from said magnetic attraction means.

4. The magnetized staple remover as claimed in claim 2 further comprising a plastic sheet, said plastic sheet fixedly secured to one of said pair of plates, a slot, said slot being disposed intermediate a marginal edge of said plastic sheet and a marginal edge of said one of said pair of plates, said magnetized plate being slideably disposed within said slot, said plastic sheet and said magnetized plate forming a cavity for the magnetic retention of said staples there-within.

* * * * *